US006108841A

United States Patent [19]

Cameron et al.

[11] Patent Number: 6,108,841

[45] Date of Patent: Aug. 29, 2000

[54] ERGONOMICAL LEG SUPPORT SYSTEM FOR A MEDICAL EXAMINATION TABLE

[75] Inventors: Diane M. J. Cameron, 79-2 Westmount Road North, Waterloo, Ontario, Canada, N2L 5G5; Katherine A. Hoye, 469 Sunrise Drive, R. R. #7, Belleville, Ontario, Canada, K8N 4Z7; Christa L Mossman, Barrie, Canada

[73] Assignees: Diane M. J. Cameron; Katherine A. Hoye, both of Ontario, Canada

[21] Appl. No.: 09/114,924

[22] Filed: Jul. 14, 1998

[51] Int. Cl.[7] ..... A47C 20/04; A61G 7/075

[52] U.S. Cl. ..... 5/648; 5/624

[58] Field of Search ..... 5/648–651, 624, 5/602

[56] References Cited

U.S. PATENT DOCUMENTS

| | | | |
|---|---|---|---|
| 2,067,891 | 1/1937 | Comper . | |
| 2,532,705 | 12/1950 | Freund | 5/624 |
| 3,516,652 | 6/1970 | Robler | 5/650 |
| 3,944,201 | 3/1976 | Mueller . | |
| 4,180,062 | 12/1979 | Alberti et al. | 297/16 |
| 4,221,370 | 9/1980 | Redwine . | |
| 4,426,071 | 1/1984 | Klevstad . | |
| 4,541,622 | 9/1985 | Tabuchi . | |
| 5,157,800 | 10/1992 | Borders | 5/648 |
| 5,214,812 | 6/1993 | Bartow et al. . | |
| 5,369,827 | 12/1994 | Parke et al. | 5/649 |
| 5,802,641 | 9/1998 | Van Steenburg | 5/648 |

OTHER PUBLICATIONS

Olson, B. Kaye, (1981)"Patient Confort During Pelvic Examination", JOGN Nursing, Mar./Apr., pp. 104–107.

*Primary Examiner*—Alexander Grosz

[57] ABSTRACT

A leg support system for use with a medical examination table in gynecological examinations has compressible thigh supports with five degrees of freedom. Four of the degrees of freedom adjust automatically and the fifth degree of freedom is manually adjustable. The system has foot rests that are in a fixed position. The system is more comfortable for users then previous systems and can accommodate users of various different sizes.

18 Claims, 5 Drawing Sheets

ERGONOMICAL LEG SUPPORT SYSTEM FOR A MEDICAL EXAMINATION TABLE

BACKGROUND OF THE INVENTION

1. Field of Invention

This invention relates to an ergonomical leg support system for use with a medical examination table and more particularly to an ergonomical leg support system that is largely automatically adjustable for various users.

2. Description of the Prior Art

It is known to have a leg support system on medical examination tables, often referred to as stirrups. The stirrups are heel supports that are usually supported horizontally outward from the top of the examination table. The stirrups can be extended longitudinally and are used for gynecological examinations. Users of the stirrups often refer to them negatively and find them extremely uncomfortable. It is very important for women to have annual gynecological examinations. However, women sometimes forgo these examinations because of the discomfort experienced in using stirrups.

SUMMARY OF THE INVENTION

It is an object of the present invention to provide a leg support system for use with a medical examination table where the system has outer thigh supports in combination with foot rests, the outer thigh supports being largely automatically adjustable so that the system can accommodate users of various sizes and support the legs of a user in a relatively comfortable position compared to previous devices.

An ergonomical leg support system is used with a medical examination table having a top. The system has two outer thigh supports, each thigh support being connected to a compressible connector. There are two foot rests. There are connecting means connecting the system to the table and elongated members interconnecting and supporting the thigh supports, foot rests and connecting means the connecting means and elongated members comprise a support frame to support the footrests and thigh supports.

DESCRIPTION OF A PREFERRED EMBODIMENT

Figure 1A:
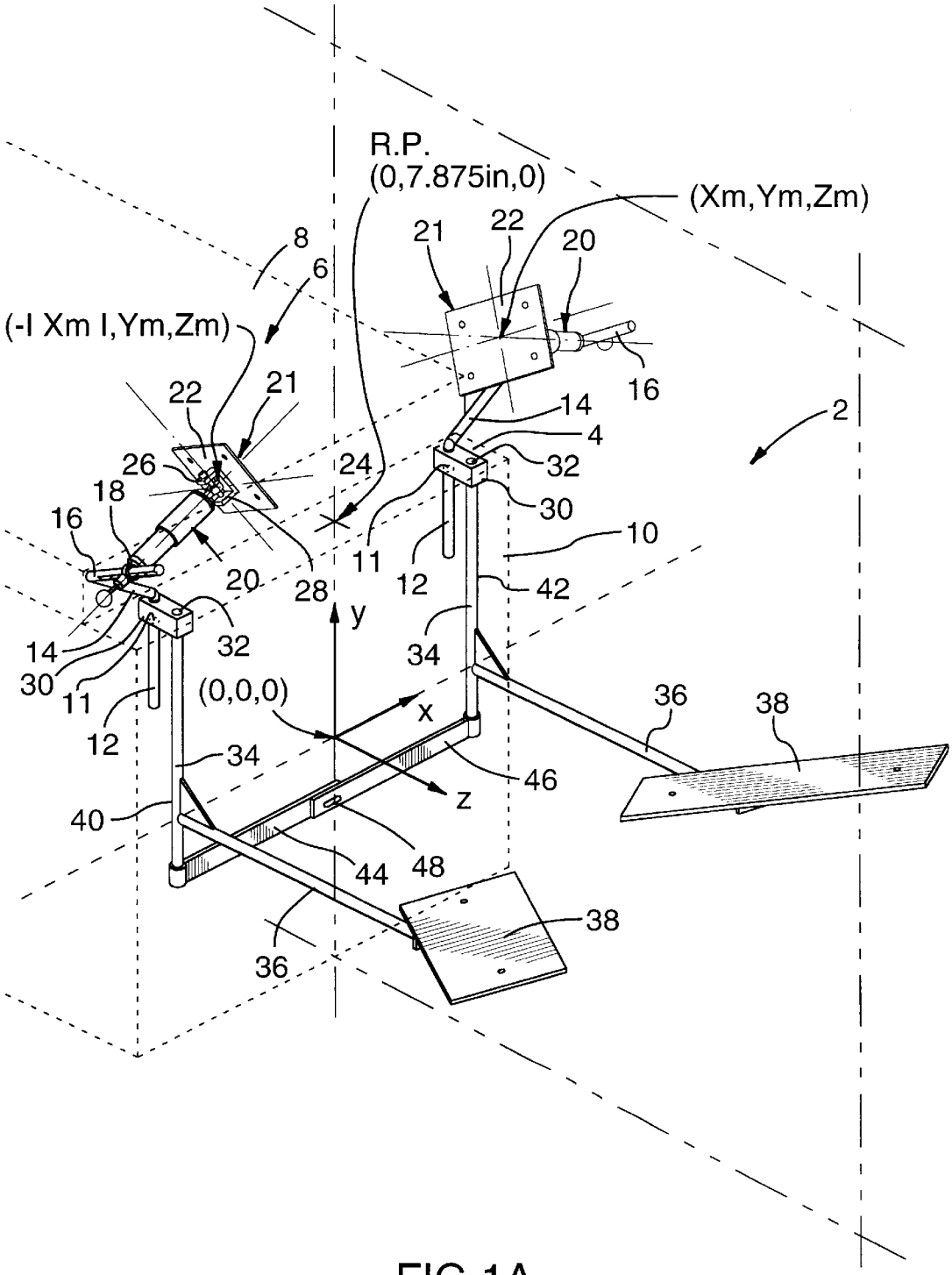
FIG. 1A is a perspective view of a leg support system will frame connected to a conventional medical examination table, footrests and thigh supports extending from the frame.
Figure 1B:
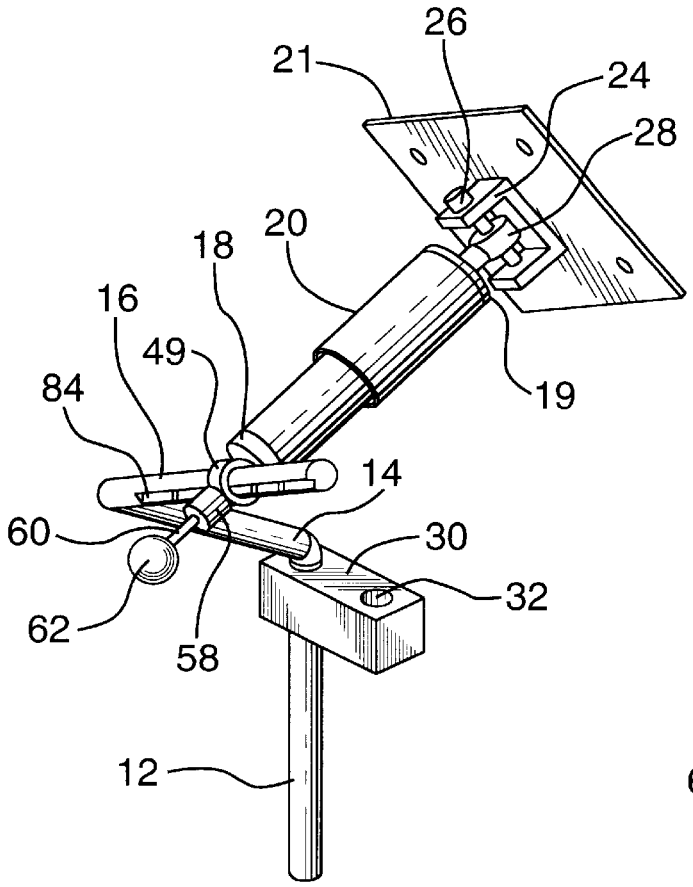
FIG. 1B is an enlarged perspective view of part of the leg support system of FIG. 1A.

There is shown in FIGS. 1A and 1B, a perspective view of an ergonomical leg support frame 2 releasably connected to an end 4 of a medical examination table 6 having a top 8. The top 8 is the upper surface of the table on which a patient rests. The top surface can be flat or have a raised portion, The top surface is usually padded. The medical examination table 6 is only partially shown (schematically with dotted lines) and has an end 10 with openings 11 therein to receive posts 12 of the frame 2. The posts 12 provide releasable connecting means between the frame 2 and the examination table 6. The leg support system could be designed as an integral part of the examination table, but is preferably releasably connected thereto. For medical examination tables that do not have the openings 11 or similar variations thereof, the connecting means of the system can be easily redesigned by simple mechanical changes to accommodate examination tables that are different from the examination table partially shown in FIG. 1. Rigidly affixed to each of the posts 12 on either side of the frame 2 are support arms 14, 16. The support arm 14, is affixed to an end of one of the posts 12. Each of the support arms 16 supports one end 18 of a compressible connector 20. The compressible connector 20 rotatable supports a plate 22 through a pivotal bracket 24 that has a pin 26 extending through an opening (not shown) of a rod end 28. The plate 22 preferably has padding (not shown in FIG. 1) thereon. The plate 22, compressible connector 20, pivotal bracket 24 and rod end 28 comprise an outer thigh support 21. The posts 12 extend through brackets 30 of the frame 2. The brackets 30 have two openings 32 (only one of which is shown in FIG. 1). One of the openings 32 is sized to receive each of the posts 12 and the opening 32 is i designed to receive elongated members 34, which, in turn support rods 36, which in turn support foot rests 38 on either side 40, 42 of the frame 2. Bands 44, 46 are longitudinally adjustable by means of a slot 48 and extend between the elongated members 34 to add stability to the frame 2 and to allow for tables of different widths.

Each of the two thigh supports 21 preferably has five degrees of freedom as follows:

(i) rotational movement about the x, y and z axes as well as translational movement along the support arm 16 and an imaginary longitudinal axis (not shown) of the compressible connector 20.

From FIG. 1B, it can be seen that the compressible connector 20 has a loop 49 at one end and a rod end 28 at an opposite end. At an outer end of the loop 49, there is located a collar 58 having a spring-mounted pin 60 slidably mounted therein and extending therefrom. The pin 60 has a handle 62 located thereon with a spring (not shown) located within the collar 58 to force the pin 60 and handle 162 inward when the handle 62 is not subjected to any external force. When the handle 62 is pulled outward, the pressure of the spring (not shown) is overcome and the pin moves outward from the loop 49.

Figure 2A:
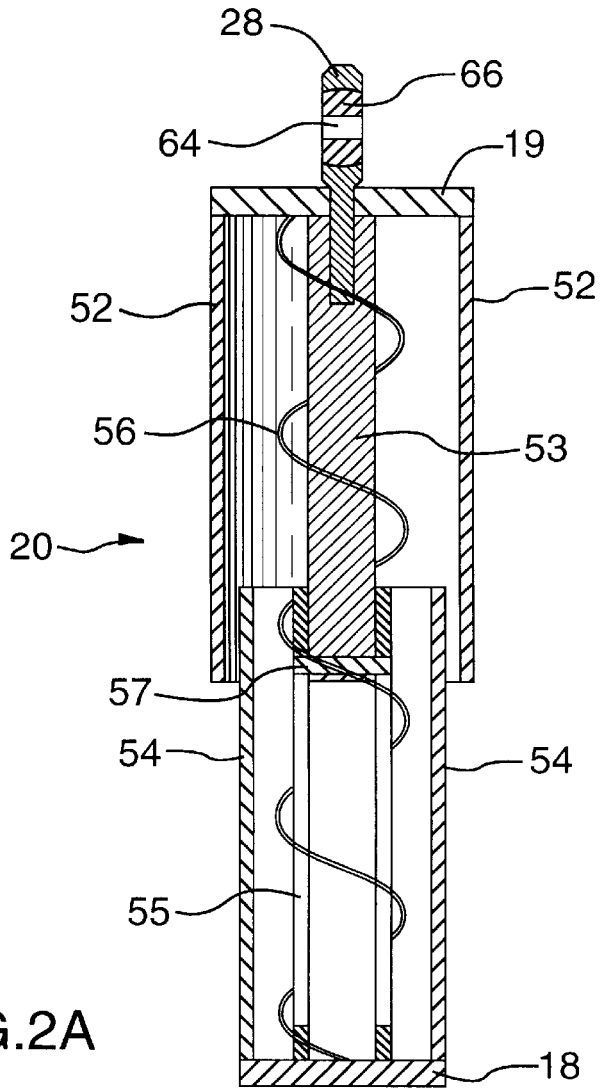
FIG. 2A is a sectional side view of a compressible strut.

In FIG. 2A, there is shown a sectional side view of the compressible connector 20. The compressible connector 20 has an outer section 52 and an inner section 54. The two sections 52, 54 are mounted coaxially so that the smaller section 54 slides within the outer section 52. The outer section 52 has an outer end 19. A spring 56 is located within the inner section 54 so that the compressible connector 20 will contract longitudinally under external pressure and expand when the pressure is released or reduced. In place of the spring 56, a gas strut or gas cylinder could be used.

Preferably, the compressible connector 20 is designed so that it is fully compressed when ten pounds of force have been placed longitudinally on the connector 20 from the plate 22 (not shown in FIG. 2A) and is fully extended when the weight is removed from the plate 22. Preferably, the compressible connector 20 will begin to contract when five pounds of force have been placed longitudinally on the connector 20 from the plate 22.

The outer section 52 contains an axially located piston 53 with a transverse pin 57 extending therethrough. When the outer sections 52, 54 slide relative to one another the pin 57 slides within a slot 55 in the inner section 54, 55. The slot limits the movement of the two sections 52, 54 relative to one another.

Figure 2B:
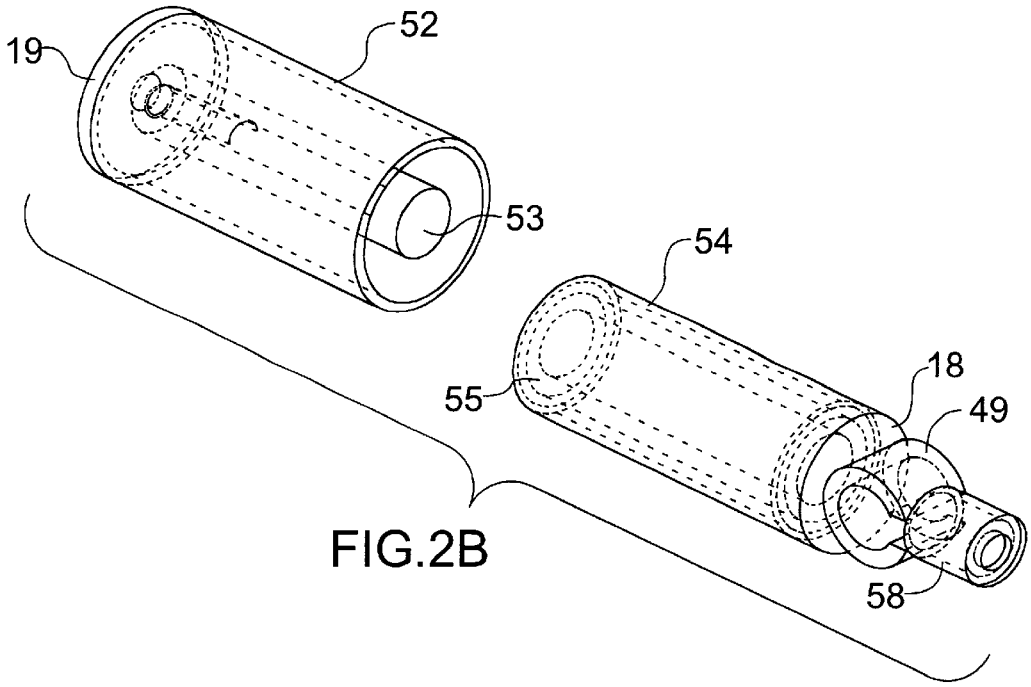
FIG. 2B is an exploded perspective view of the compressible connector with dotted lines to show an interior.
Figure 2C:
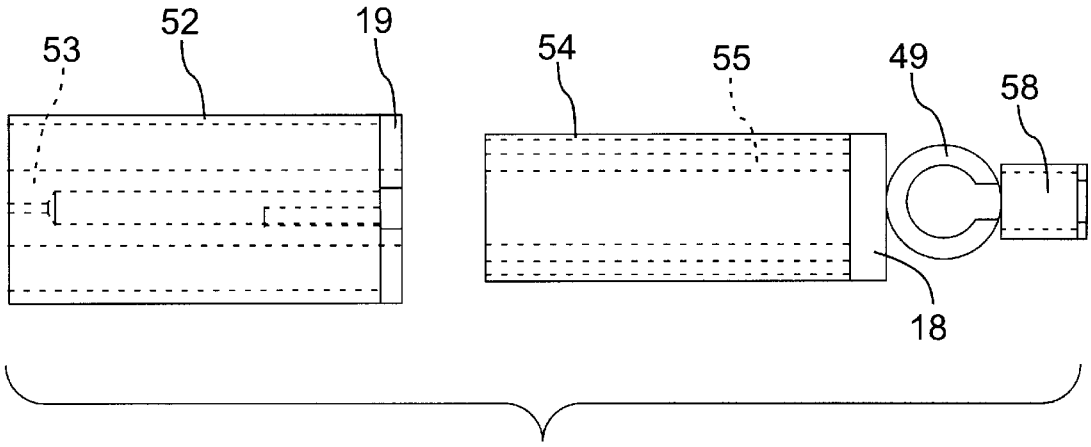
FIG. 2C is an exploded side view of the compressible connector.

The rod end 28 contains a circular opening 64 with a bearing 66 mounted therein. The opening 64 is designed to receive the pin 26 of the pivotal bracket 24. The bearing 66 preferably permits a total of approximately seven and one-half degrees of movement in two directions about one axis and approximately seven and one-half degrees of movement in two directions about another axis and adds two degrees of freedom to the plate 22 (not shown in FIG. 2A). The two axes are orthogonal to one another. The pin 26 and pivotal bracket 24 represent another degree of freedom of the plate 22. The bearing 66 provides a universal joint between the pin 26 and the compressible connector 20. FIGS. 2B and 2C use the same reference numerals as FIG. 2A.

Figure 3:
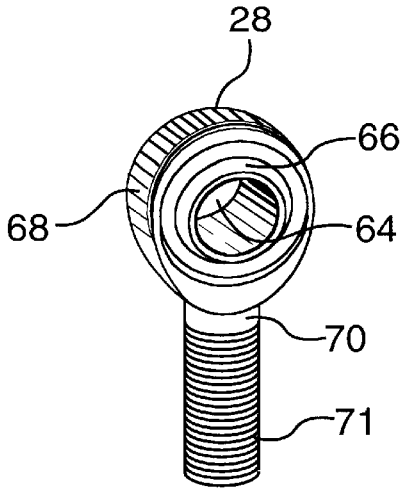
FIG. 3 is a perspective view of a rotational rod end.

In FIG. 3, there is shown a perspective view of the rod end 28 with the opening 64 extending through the bearing 66 that is mounted in the loop 68. As can be seen, a cylindrical section 70 has a screw thread 71 thereon.

Figure 4:
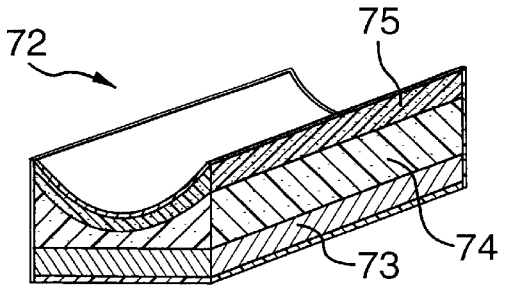
FIG. 4 is a perspective view of a padded thigh support.

In FIG. 4, there is shown a perspective view of a part of a padded thigh support 72 having a wood base 73, a layer of hard foam 74 and a layer of soft foam 75. Preferably, a layer of vinyl (not shown) surrounds the thigh support.

Figure 5:
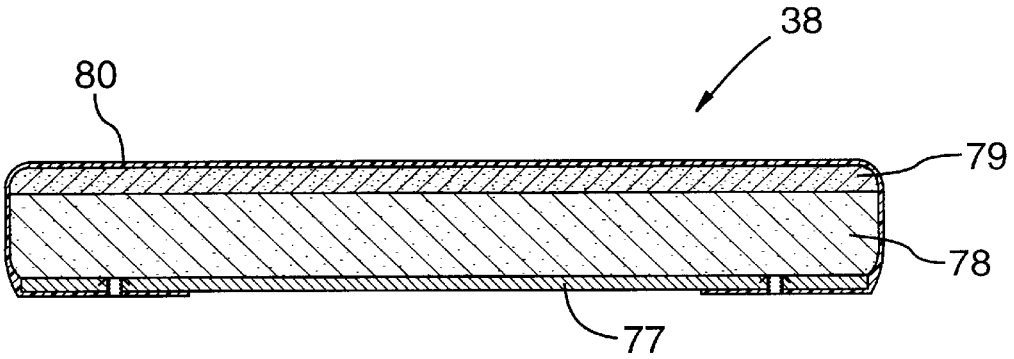
FIG. 5 is a sectional side view of a padded foot rest.

In FIG. 5, there is shown a sectional side view of the padded foot rest 38 which also has a wood base 77, a layer of hard foam 78 and a layer of soft foam 79. Preferably, the foot rest 38 is surrounded by a layer of vinyl 80.

The plate 22, bracket 24, rod end 28, pin 26, compressible connector 20, loop 48, collar 58, pin 60 and handle 62 comprise an outer thigh support 21.

Figure 6:
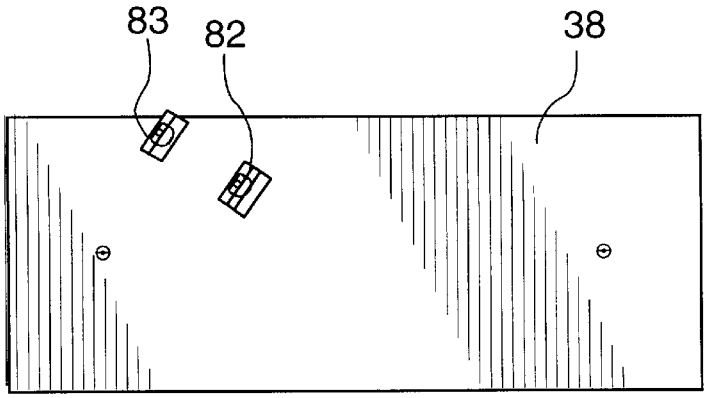
FIG. 6 is a bottom view of a foot rest.

In FIG. 6, there is shown a bottom view of the foot rest 38. Preferably, the foot rest 38 is oversized by approximately 50% when compared to the foot of a typical user. The foot rest 38 has two brackets 82, 83 mounted at an angle on said bottom so that the foot rest 38 extends outward and slightly upward from the elongated member 36. The bracket 83 is slightly shorter than the bracket 82 to obtain the proper angle.

Figure 7A:
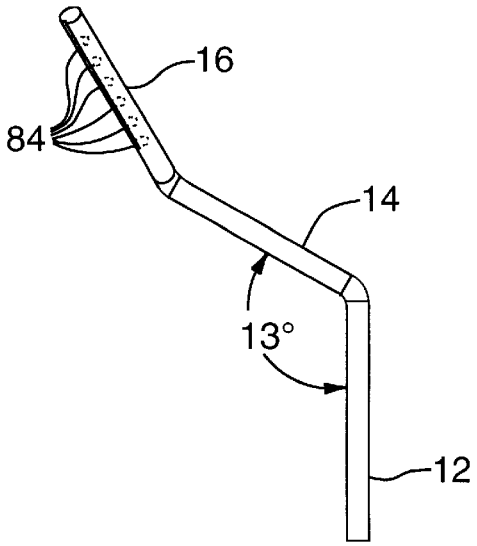
FIG. 7A is an end view of a support arm containing notches for various positions as viewed from an end of the examination table.

In FIG. 7A, there is shown an end view of the posts 12 and support arms 14, 16 that are rigidly connected to one another as viewed from the end of the examination table. The support arm 14 is at an angle 13 to the post 12. The angle 13 is approximately one hundred and twenty-nine degrees plus or minus five degrees. The support arm 16 contains a plurality of openings 84 therein to receive the pin 60 shown in FIG. 2 so that the outer thigh support can be moved longitudinally to any of the positions represented by the openings 84 simply by pulling on the handle 62 shown in FIGS. 1A and 1B. When the handle 62 is released, the pin will retract and if the outer thigh support is in the desired position along the length of the support arm 16 the handle is released and the outer thigh support is releasably locked in that position.

Figure 7B:
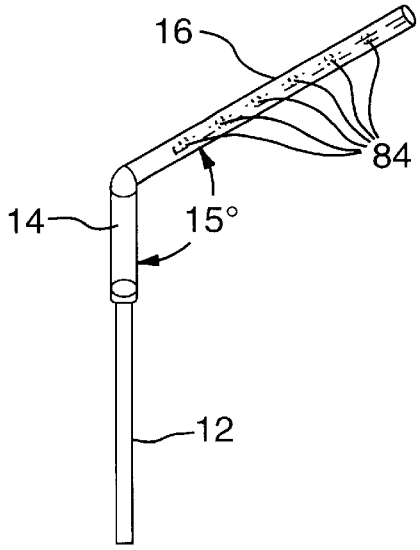
FIG. 7B is a side view of the support arm of FIG. 7A.
Figure 7C:
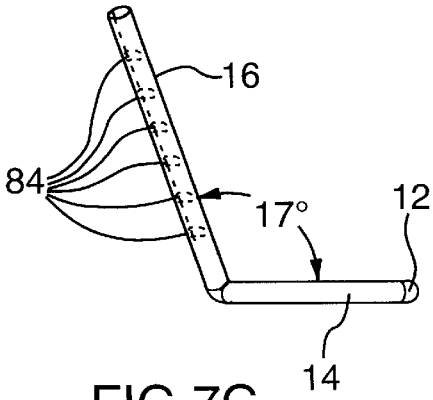
FIG. 7C is a top view of the support arm of FIG. 7A.

The same reference numerals are used in FIGS. 7B and 7C as used for FIG. 7A. FIG. 7B is a side view and FIG. 7C is a top view of the support arms 14, 16. An angle 15 between the support arms 14, 16 when viewed from the side of post 12 is approximately one hundred and forty-two degrees plus or minus five degrees. An angle 17 between the support arms 14, 16 when viewed from a top of the post 12 is approximately one hundred and twenty-four degrees plus or minus five degrees.

Figure 8:
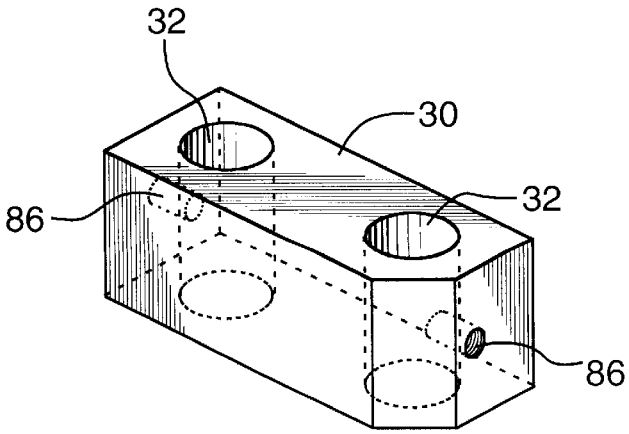
FIG. 8 is a perspective view of a bracket.

In FIG. 8, there is shown the bracket 30 containing openings 32 for receiving the posts 12 and the elongated members 34. Openings 86 are designed to receive set screws (not shown) for the posts 12.

The leg support system of the present invention is designed to be suitable for all women lying in the range of the fifth to ninety-fifth percentiles of women in height, whether the women are heavy or light. The pad portion of the thigh supports has a curvature to provide additional comfort. The thigh supports support the outer thighs without applying external force to the knee or hip joints. Preferably, the pads of the thigh supports measure approximately six inches by approximately four inches. The length, orientation, and location of the support arms were determined using regression analysis. The positive z axis was defined to lie parallel to the length of the table in a direction which points from the head of the table to the foot of the table. The positive y axis was defined to be the upward direction. The origin was located twenty centimeters; below the center line of the surface of the table directly beneath the pudendum positioned at a reference point, shown as R.P. in FIG. 1A of an imaginary patient. The positive x access was defined to be parallel to the width of the table in the left direction for a patient on the table. The following equations were obtained by regression analysis:

$$y=1.2659\ z+10.274 \quad (1)$$

$$x=0.67451\ z+7.258 \quad (2)$$

$$2.5\leqq z\leqq 5.0 \quad (3)$$

Equations (1) and (2) describes the movement of the surface of the thigh pad in space. Equation (3) defines the endpoints of the line in equations (1) and (2).

The spring 56 in the compressible connector is preferably designed so that the pad portion of the thigh support will compress more for a patient with heavier thighs than it will compress for a patient with lighter thighs. The pad portion of the thigh supports are free to rotate around the pivot point within a suitable and limited range of angles. Rotation around the axis parallel to the femur is preferably centred at seventy degrees from the horizontal. Rotation about the axis which is normal to the plane which is tangent to the surface of the thigh of a patient at the location of the pad is preferably limited to plus or minus eight degrees from the resting position of the pad. Freedom to rotate within this limited range accommodates women with different lengths of legs and different femur-tibia ratios. Rotation about the line with the greatest gradient which lies in the plane tangent to the surface of the thigh of a patient at the location of the pad is limited to plus or minus eight degrees from the resting position of the pad.

Since a patient's legs are preferably abducted thirty-four degrees and rotated outward ten degrees at the hip, the patient's feet will angle outward slightly more than thirty-four degrees. The foot rests are therefore angled at thirty-four degrees from an imaginary center line plane (x=0) through the examination table, as shown in FIG. 1A in dashed outline. In order to support the outward rotation of the leg of a patient, the foot rests also tilt outwards at an angle of ten degrees. The foot rests are located in a fixed position and in order to accommodate women of various sizes, the foot rests have pads with a size of approximately one and half times the width and the length required for the average woman. Preferably, each foot rest is approximately sixteen inches long and six inches wide. The foot rests are preferably positioned at a level below the top surface of the examination table, thereby causing a vertical drop from the buttocks to the heels of a patient.

The leg support system of the present invention has several advantages. The thigh supports support approximately ten degrees of outward rotation at the hip of a patient. The leg support system causes the patient to be in a rest position without any static muscle contractions. The thigh supports do not apply pressure on the knee joint and they do not apply pressure behind the leg, which increases circulation. The thigh supports of the present invention are not load bearing. The leg support system increases visibility of and access to the external genitalia.

The foot rests are located far enough away from an end of the examination table that the degree of flexion at the knee of a patient using the leg supports is approximately ninety degrees. This is much less than the degree of flexion when using typical stirrups.

The physical comfort achieved by the leg support system of the present invention provides psychological comfort to the patient as well. As women are able to achieve a greater degree of relaxation, the reluctance to arrange regular gynecological examinations will dissipate.

The leg support system of the present invention is designed to automatically adjust for women of different sizes because the thigh supports compress more for patients who are heavier than for patients who are lighter. Preferably, there is one manual adjustment on each side as well. Variations, within the scope of the attached claims, will be readily apparent to those skilled in the art. The leg support system can be an add-on feature to an existing examination table or it can be made integral with an examination table. The compressible connector can be designed in various different ways to achieve the same result or described in the present application, but is preferably designed as described.

We claim:

1. An ergonomical leg support system for use with a medical examination table having a top surface and center-line plane wherein a patient's pelvis and upper body are supported on the table with feet and thighs supported by the leg support system in a predetermined patient position symmetric the center-line plane, the leg support system comprising:

a support frame mounted to the examination table;

two opposing foot rest means, mounted to the frame and disposed below the top surface of the examination table, for supporting the soles of the patient's feet wherein the patient's pudendum is disposed at a reference point on said center-line plane;

two opposing thigh support means each having a compressible member compressibly connecting a thigh pad to the frame, for engaging an outer lateral surface of each of the patient's thighs and for moving the thigh pads in three-dimensional space between an unloaded position and a loaded position in response to a force exerted by the patient's thigh on each thigh pad.

2. A system according to claim 1 wherein the foot rest means and thigh support means are disposed relative to the table top surface and center-line plane thereby positioning the patient with:

heels about 20 cm. below the reference point.

3. A system according to claim 1 wherein the foot rest means and thigh support means are disposed relative to the table top surface and center-line plane thereby positioning the patient with:

leg abduction of about 34°.

4. A system according to claim 1 wherein the foot rest means and thigh support means are disposed relative to the table top surface and center-line plane thereby positioning the patient with:

outward rotation at the hip of about 10°.

5. A system according to claim 1 wherein the foot rest means and thigh support means are disposed relative to the table top surface and center-line plane thereby positioning the patient with;

flexion at the knee of about 90°.

6. A system according to claim 1 wherein the foot rest means and thigh support means are disposed relative to the table top surface and center-line plane thereby positioning the patient with:

plantar flexion outward and upward from the patient's heel toe.

7. A system according to claim 1 wherein the foot rest means and thigh support means are disposed relative to the table top surface and center-line plane thereby positioning the patient with.

heels about 20 cm. below the reference point;

outward rotation at die hip of about 10°;

leg abduction of about 34°, flexion at the knee of about 90°; and plantar flexion outward and upward from the patient's heel to toe.

8. A system according to claim 1 wherein the force exerted by the lateral surface of the patient's thigh on each thigh pad is in the range of 5 to 10 lbs directed normal to a midpoint of the thigh pad.

9. A system according to claim 1 wherein a midpoint ($x_m$, $y_m$, $z_m$) of the thigh pads is movable along a line in three dimensional space defined by the following equations wherein:

an origin (x=0 in., y=0 in., z=0 in.) is located 20 cm (7.875 in,) below said reference point (0.7.875 in., 0) on the center-line plane (wherein x=0) of the examination table;

a positive z-axis is defined in said plane extending from the origin toward the patient's feet;

a positive y-axis is defined in said plane extending from the origin upwards:

a positive x-axis is defined orthogonal said plane extending toward the patient's left side;

such that:

$$2.5 \text{ in.} \leq z_m \leq 5.0 \text{ in.};$$

$$y_m = 1.2659\ z_m + 10.274 \text{ in.: and}$$

$$[x_m] = 0.67451\ z_m + 7.258 \text{ in.}$$

10. A system according to any one of claims 1 or wherein the thigh support means further include manual adjustment means for manually locating the thigh pads in a selected unloaded position.

11. A system according to claim 10 wherein the frame comprises two brackets (30) and each thigh support means further comprise a first support arm (14) mounted to one of said bracket (30).

12. A system according to claim 11 wherein each first support arm (14) includes a post (12) disposed in the bracket (30), each first support arm (14) and post (12) being disposed at an elevation angle (13) of about 128°±5° relative to each other.

13. A system according to claim 12 wherein each first support arm (14) includes a second support arm (16) extending opposite the post (12), each first support arm (14) and second support arm (16) being disposed at an elevation angle (15) of about 142°±5°, and at a plan angle (17) of about 124°±5° relative to each other.

14. A system according to claim 13 wherein one of said compressible members (20) compressibly connects one said thigh pad (22) to one said second support arm (16).

15. A system according to claim 14 wherein the manual adjustment means comprise a series of notches (84) along each second support arm (16) and manually releasable latch means (58, 60, 62) disposed on each compressible member (20).

16. A system according to claim 14 wherein the thigh support means includes pivotal connector means, (28, 24) disposed between each compressible member (20) and each thigh pad (22), for pivoting the thigh pad (22) about three orthogonal axes.

17. A system according to claim 16, wherein the thigh pads (22) have a length and height, and wherein the pivotal connector means (28, 34) permits pivoting of each thigh pad 22: in the range between ±8° about a longitudinal axis of the compressible member (20); in the range between ±8° about an axis along the height of the thigh pad (22); and ±180° about an axis along the length of the thigh pad (22).

18. A system according to claim 11 wherein each bracket (30) includes examination table mounting pin means (12) for retrofitting each of the brackets (30) into stirrup sockets in the examination table.

* * * * *